US011457677B2

(12) United States Patent
Sun et al.

(10) Patent No.: US 11,457,677 B2
(45) Date of Patent: Oct. 4, 2022

(54) MULTI-PURPOSE FACE MASK

(71) Applicants: Dominique Sun, Tustin, CA (US); Rachel Sun, Tustin, CA (US)

(72) Inventors: Dominique Sun, Tustin, CA (US); Rachel Sun, Tustin, CA (US)

( * ) Notice: Subject to any disclaimer, the term of this patent is extended or adjusted under 35 U.S.C. 154(b) by 278 days.

(21) Appl. No.: 16/900,959

(22) Filed: Jun. 14, 2020

(65) Prior Publication Data

US 2021/0329994 A1 Oct. 28, 2021

Related U.S. Application Data

(60) Provisional application No. 63/015,999, filed on Apr. 27, 2020.

(51) Int. Cl.
*A41D 13/11* (2006.01)
*A41D 31/02* (2019.01)

(52) U.S. Cl.
CPC ..... *A41D 13/1161* (2013.01); *A41D 13/1115* (2013.01); *A41D 31/02* (2013.01)

(58) Field of Classification Search
CPC . A41D 13/1161; A41D 13/1115; A41D 13/11; A62B 23/025
See application file for complete search history.

(56) References Cited

U.S. PATENT DOCUMENTS

| | | | | |
|---|---|---|---|---|
| 2016/0360871 | A1* | 12/2016 | Schessel | F16B 2/005 |
| 2017/0367417 | A1* | 12/2017 | Takashina | A44B 99/00 |
| 2019/0166929 | A1* | 6/2019 | Bergman | A41D 13/1138 |
| 2021/0307420 | A1* | 10/2021 | Capotosto | A41D 13/1161 |
| 2021/0316170 | A1* | 10/2021 | Domoy | A62B 23/025 |
| 2021/0316173 | A1* | 10/2021 | Elsherif | B01D 39/083 |
| 2021/0345696 | A1* | 11/2021 | Farshoukh | A41D 13/113 |
| 2021/0345705 | A1* | 11/2021 | Smith | A41D 13/1161 |
| 2022/0125135 | A1* | 4/2022 | Law | A41D 13/1107 |

* cited by examiner

*Primary Examiner* — Katherine M Moran

(57) ABSTRACT

A face mask has an outer layer made of a polyester-cotton blend material, an inner layer that is stitched or sewn to the outer layer in a manner which defines a pocket space between the inner and outer layers, and having a slit provided along an edge of the inner layer providing access to the pocket space. A replaceable filter piece can be inserted into, or removed from, the pocket space via the slit. The face mask can be provided with straps that are adjustable.

6 Claims, 3 Drawing Sheets

MULTI-PURPOSE FACE MASK

BACKGROUND OF THE INVENTION

1. Field of the Invention

The present invention relates to face coverings, and in particular, to a multi-use face mask that is adapted to be worn by a person who is engaging in an athletic activity as well as in normal social activities.

2. Description of the Prior Art

The coronavirus named COVID-19 invaded the world in late 2019 and has turned many existing "normal" practices and activities on their heads. The most dangerous aspect of COVID-19 is the fact that many carriers of the virus exhibit no symptoms. Among the asymptomatic, some can be asymptomatic for up to two weeks before showing symptoms, while others can remain completely asymptomatic and never show any symptoms. This characteristic is quite unlike other previously-known viruses, including SARS, H1N1, and MERS, and has caused great concern among scientists, researchers, governments and health officials as they try to contain or minimize the spread of the virus among populations.

Important by-products of this asymptomatic characteristic include new ways of looking at how the virus spreads, and in protecting people from asymptomatic carriers. This has also led to a change in social norms and conventional thinking, where everyone is now supposed to assume that they are carrying the virus even though they show no symptoms. In other words, the focus has shifted to protecting each person from every other person that he/she could encounter in any social setting, even if these other people actually do not have the virus. One early mechanism utilized by almost all governments and health officials is social distancing, where no one is supposed to be within six feet of another person. However, as COVID-19 spread throughout the world and people began to learn more about it, it is now suspected that the COVID-19 virus particles can travel for distances further than six feet, or remain as part of aerosol for longer periods of time. As a result, social distancing alone would not be enough to minimize and prevent spread.

Another problem with social distancing is that there are some environments or settings where it is not possible to maintain any reasonable distance between people. The best examples are public transportation such as subways and buses. Large settings like concerts and sporting events are also problematic. Densely populated accommodations such as prisons, slums or low-income housing also pose a different set of issues. Finally, there are jobs and activities where it can be impossible to maintain the needed distance. The best examples are health workers who treat patients. Another example is people who participate in sports or athletic activity where physical contact and proximity cannot be avoided, such as American football, soccer, basketball and rugby.

To protect people in these "close-contact" situations, people have been required to wear masks. Prior to COVID-19, the main idea behind face masks is their use as PPE (personal protection equipment), where the wearer protects himself/herself from virus that has been expelled by others. People who are sick will also wear face masks to protect those around them. The most common form of protective face masks includes N95 masks and the regular surgical masks ("medical masks") used by doctors and health workers. Prior to COVID-19, asymptomatic people usually do not wear any form of face coverings. Therefore, these N-95 and medical masks have been designed to provide a certain level of filtering so that virus particles cannot pass through the mask, either from the wearer or to the wearer.

However, due to the shortage of masks during the initial COVID-19 outbreak, and to maintain a sufficient supply of N95 and medical masks for hospital and medical workers, health officials have been instructing people to fashion face coverings out of any cloth material, with the message that any form of face covering is better than no face covering. Thus, the focus has now shifted from protecting the wearer to protecting others from the wearer ("source control"). Immediately, many companies and businesses started to make and sell large quantities of regular cloth masks.

Unfortunately, face coverings made from regular cloth materials that are normally used for clothing, bandanas, scarves and the like, are not effective as barriers because they do not effectively filter out virus particles. Brousseau and Sietsema ("Masks-for-all for COVID-19 not based on sound data", cidrap.umn.edu, Apr. 1, 2020, https://www-.cidrap.umn.edu/news-perspective/2020/04/commentary-masks-all-covid-19-not-based-sound-data) present an interesting study outlining the efficiency and fit of N95, medical and regular cloth masks, and conclude that cloth masks are not effective as both PPE and source control protection devices. Brousseau and Sietsema's study found that medical masks exhibit a significantly greater degree of filtering efficiency than regular cloth masks. Despite this drawback, it is believed that wearing a face covering would help to control or limit the expulsion of virus particles when a person sneezes or exhales. For example, a person sneezing or exhaling into a face covering would result in the face covering limiting the distances to which the droplets can be projected, so that even if a face covering cannot minimize the amount of droplets or particles being expelled, it can at least limit the expulsion to a small distance from the wearer.

The post-COVID-19 world will likely see many changed behaviors, and it is likely that some form of face covering will now be a part of every person's regular daily apparel. This means that everyone will likely be wearing a face covering in public and while engaging in any social activity. There are regular activities such as shopping, working, socializing with friends, attending a concert or visiting a museum, but there are also "extreme" activities, such as a sporting game, where a person is experiencing physical exertion which causes a rise in body temperature and sweat.

To provide the best results, a person can use a medical mask for most regular activities. However, these medical masks may not be appropriate for use in these "extreme" activities simply because they are made from different materials. Filters used in conventional medical masks must allow the user to breathe and thus cannot clog when particles adhere to their fibers. Medical mask filters are typically composed of mats of nonwoven fibrous materials, such as wool felt, fiberglass paper, or polypropylene. The material creates a tortuous path, and various mechanisms result in the adhesion of particles to the fibers without necessarily blocking the open spaces, still allowing air to flow easily across the filter.

There are at least two mechanisms for removing particles from the airstream: inertial impaction and diffusion. Mechanisms for removing large particles differ from those for small particles. It is believed that inertial impaction is effective for aerosol particles that are approximately 1 μm and larger. Such particles have enough inertia that they cannot easily flow around the respirator fibers. Instead of flowing through the filter material, the large particles deviate from the air streamlines and collide with the fibers and may stick to or be caught in them. For much smaller particles (those that are 0.1 μm and smaller), diffusion is regarded as an effective filtration mechanism. Brownian motion, which is the process by which the constant motion of oxygen/nitrogen molecules causes collisions between particles, results in a "wandering" pathway. The complex path that is followed by the small particles increases the chance that they will collide with the filter fiber and remain there.

The mats of nonwoven fibrous materials (such as wool felt, fiberglass paper, or polypropylene) used for medical masks differ significantly from regular cloth materials, such as cotton, silk or polyester. However, these nonwoven fibrous materials are not intended nor made for use with "extreme" activities, as heavy breathing and sweat will quickly destroy the nonwoven fibrous materials.

Therefore, people engaging in sports or similar activities will require a different type of mask.

In addition, any person who engages in a sporting or similar activity will likely be breathing heavily and perspire. This person will need to have enough oxygen to be able to maintain the need level of physical activity, so whatever face covering that this person wears must allow for close to regular breathing. The face covering must also allow for exhaled air (especially the carbon dioxide) to be vented out quickly and replaced by fresh air so that the wearer is not inhaling more recycled air that is still inside the face covering.

An additional requirement for a face covering for sporting athletes is that it be low-cost. Sports such as soccer, basketball and baseball are currently being enjoyed by adults and children across a wide spectrum of society, and the largest percentage of such athletes originate from low-income or poorer segments of society. As a result, it is important that they have access to face coverings that they can afford to acquire so that they can continue to enjoy their favorites sporting activities in a safe manner.

Finally, most conventional medical masks and cloth masks are not suitable for use during activities where the wearer is experiencing significant movement, such as during certain sports or when running, because the straps that secure the face mask to the wearer's face do not provide a sufficiently tight or secure fit such that the face mask can slip and otherwise fall off.

Thus, there remains a need to provide an inexpensive face covering that can be worn by any person engaging in any recreational sporting activity, where the face covering is adapted for use in the environment presented by a sporting activity, which can be effective in providing a "source control" to the spread of viral particles, and which provides a secure fit for the face mask to the wearer's face.

SUMMARY OF THE DISCLOSURE

In order to accomplish the objects of the present invention, there is provided a face mask having an outer layer made of a polyester-cotton blend material, an inner layer that is stitched or sewn to the outer layer in a manner which defines a pocket space between the inner and outer layers, and having a slit provided along an edge of the inner layer providing access to the pocket space. A replaceable filter piece can be inserted into, or removed from, the pocket space via the slit. The face mask can be provided with straps that are adjustable.

DETAILED DESCRIPTION OF THE PREFERRED EMBODIMENTS

Figure 1:
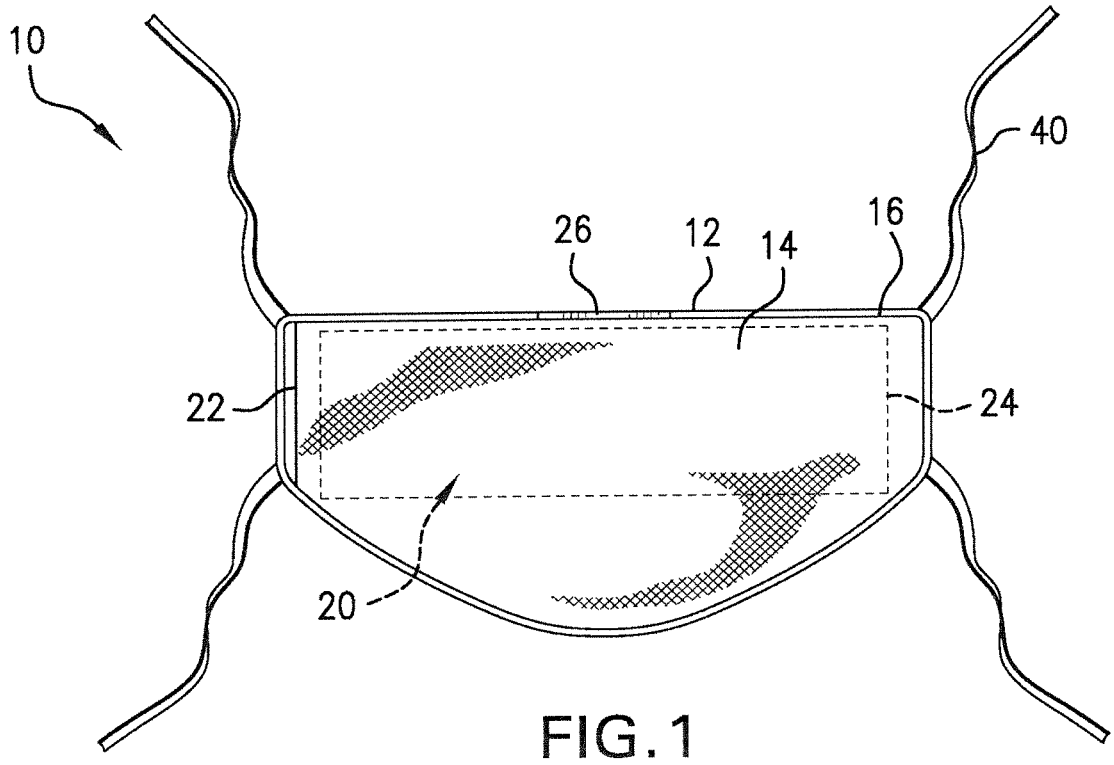
FIG. 1 is a rear view of a face mask according to my invention showing the rear or inside of a face mask according to one embodiment of the invention.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The present invention provides a face covering or face mask 10 that has multiple layers of a cloth material with a filter pocket defined between the multiple layers. A filter material can be removably inserted into the filter pocket.

The present invention also provides a face mask 10 that allows the wearer to adjust the tightness and fit to the wearer's face so that the face mask 10 will not slip or fall off so easily when the wearer engages in a sporting activity.

According to one embodiment, two layers 12 and 14 of cloth-like material can be cut into the shape of a face mask and stitched or sewn together. See FIGS. 1 and 2. Additional stitch lines 16 can be made in the fabric of the layers 12 and 14 to define a pocket space 20. A slit 22 can be provided along the top-down (vertical) direction of the inner layer 14 to provide access to the pocket space 20. Alternatively, the slit 22 can be provided along the left-right (horizontal) direction of the inner layer 14 to provide access from the top edge of the face mask. A piece of filter 24 can be inserted through the slit 22 to place the filter 24 inside the pocket space 20. The filter 24 can be removed by pulling the filter from the pocket space 20 through the slit 22. A short nose piece 26, which can be made of a bendable metal strip, can be provided along an upper edge of the face mask 10 to conform the upper edge of the face mask 10 to a wearer's nose. In a simple application, straps 40 can be provided along the edges of the outer layer 12 for tying the straps 40 at the back of the wearer's head so as to secure the face mask 10 against the wearer's face.

Some current sports goods suppliers (e.g., SCORE Sports) are currently providing a face mask for use by soccer players; however, this face mask is only made of one or two layers of 100% polyester material with no filter element. A big reason for the use of 100% polyester is that the wearer's sweat would stay on his/her face and eventually evaporate because polyester is a moisture wicking fabric that is water resistant and keeps water out. However, polyester exhibits the poorest filtering results when compared to even cotton. Therefore, such a face mask would not be effective in filtering virus and other particles. This can be detrimental as certain sports such as soccer and basketball require players to be exhaling very close to other players.

As a result, the two layers 12 and 14 of cloth-like material in the present invention can be made from a blend of polyester and cotton, where the percentage of polyester is at least 50%. One preferred embodiment provides a blend of 65% polyester and 35% cotton. Since cotton provides better filtration performance than polyester, providing a blend of cotton and polyester for the layers 12 and 14 will provide more effective filtration for the areas of the face mask 10 that are not covered by the filter 24. In addition, the high percentage of polyester would ensure that the wearer's sweat would stay on his/her face and eventually evaporate.

In addition, the front layer 12 of the face mask 10 can be provided with pleats 30 to facilitate a better and tighter fit with the face of the wearer.

The filter 24 can be any conventional filter, such as the "Mouth Mask Filters Breathing Insert Protective Mask Filter" items that are currently being sold on Amazon.com. The slit 22 and the pocket space 20 should be sized and configured to allow a piece of conventional filter 24 to be conveniently inserted and removed.

In addition, the filter 24 can be another cloth layer, such as another cotton, polyester or poly-cotton layer. Even though fabric such as cotton, polyester, or poly-cottons, are not as effective in filtering as the filter materials found in conventional protective mask filters, the provision of additional layers will help to filter out more particles, and can provide the wearer with the option of using different filter materials. In addition, this allows the wearer to better adjust the breathability/filtering balance, as certain fabric materials may not be as effective as filters yet provide better breathability, while protective mask filters may provide better filtering yet are less breathable.

In use, a consumer can purchase a face mask 10 and use it as a washable and re-useable mask. The wearer can use the face mask 10 without any filter 24, or the wearer can insert a filter 24 for one-time or limited use. At the end of a soccer or basketball game or sporting activity, the filter 24 can be removed and discarded, and the face mask 10 washed. A new filter 24 can be used for a new game. If the filter 24 is another fabric material, then it can be washed and re-used.

Thus, the present invention provides a multi-use re-useable face mask 10. The wearer can use the face mask 10 for regular social (non-sports) use in the same manner as the wearer would use any of the commonly-available cloth masks. When the wearer participates in a sports game, he/she can insert a filter 24 to provide more effective filtering ability in an environment where effective filtering is more important. The filter 24 can be a piece of cloth (e.g., cotton or poly-cotton) if the wearer desires better breathability when engaged in a sporting activity, or can be a conventional protective mask filter if the wearer is in a crowded social area where better filtering is desired.

The present invention allows the wearer the flexibility to adjust the level of protection provided by the face mask 10 depending on the environment that the wearer is in. Given the fact that a person could be in several different environments on any given day, the ability to adjust the level of protection (filtering) and breathability is valuable. As a result, the face mask 10 can be enjoyed by almost any active person whose daily lives require that he/she be in different environments at different times of the day, and would obviate the need for any person to carry multiple face masks. This person could carry one face mask 10 with multiple filters 24 for use during any given day.

Finally, the face mask 10 is very breathable in that the polyester-cotton blend provides a very breathable material. By providing the blend to be at least 50% polyester, breathability is facilitated while maximizing comfort and filtering effectiveness.

In addition, the face mask 10 is inexpensive as it is made of two layers of blended poly-cotton materials, and these separate filters also not expensive as they are readily available.

Figure 2:
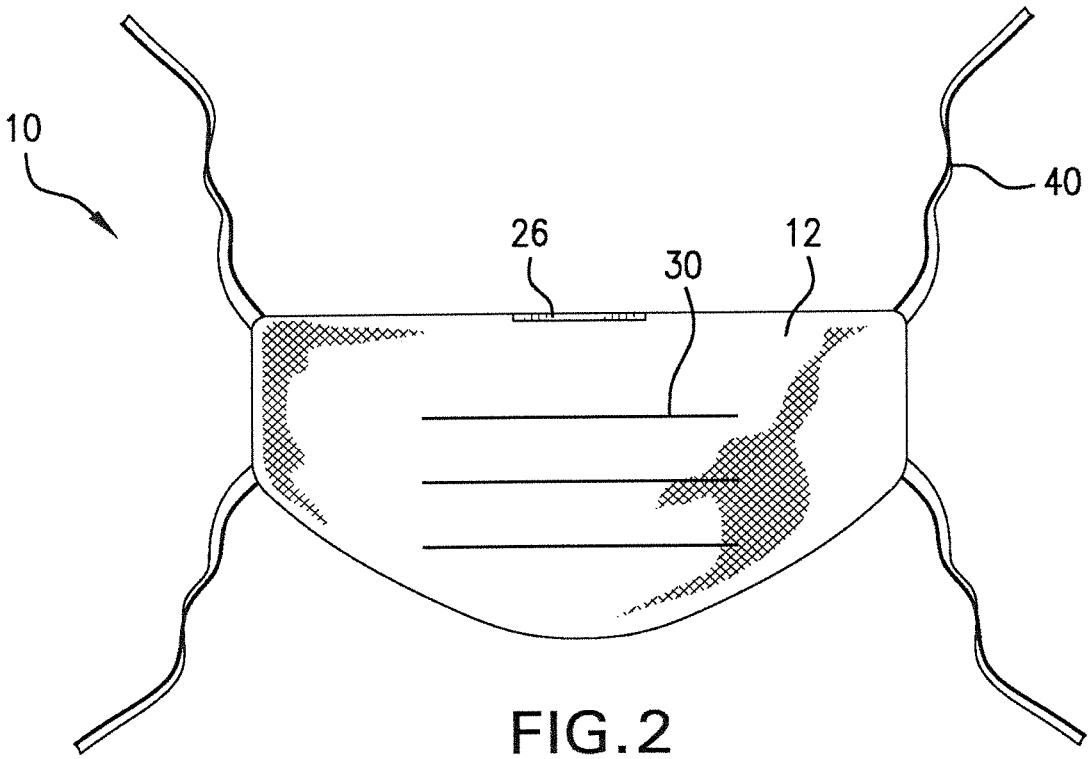
FIG. 2 is front view of the mask of FIG. 1 showing the front or outside of the face mask.
Figure 3:
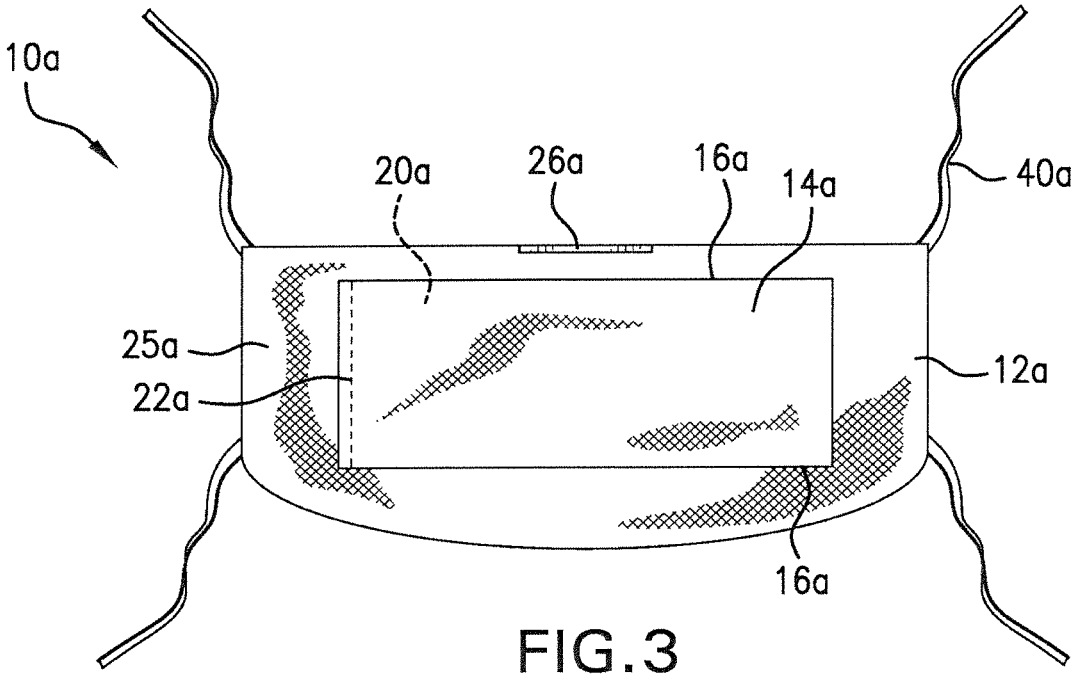
FIG. 3 is a rear view of a face mask according to my invention showing the rear or inside of a face mask according to another embodiment of the invention.
Figure 4:
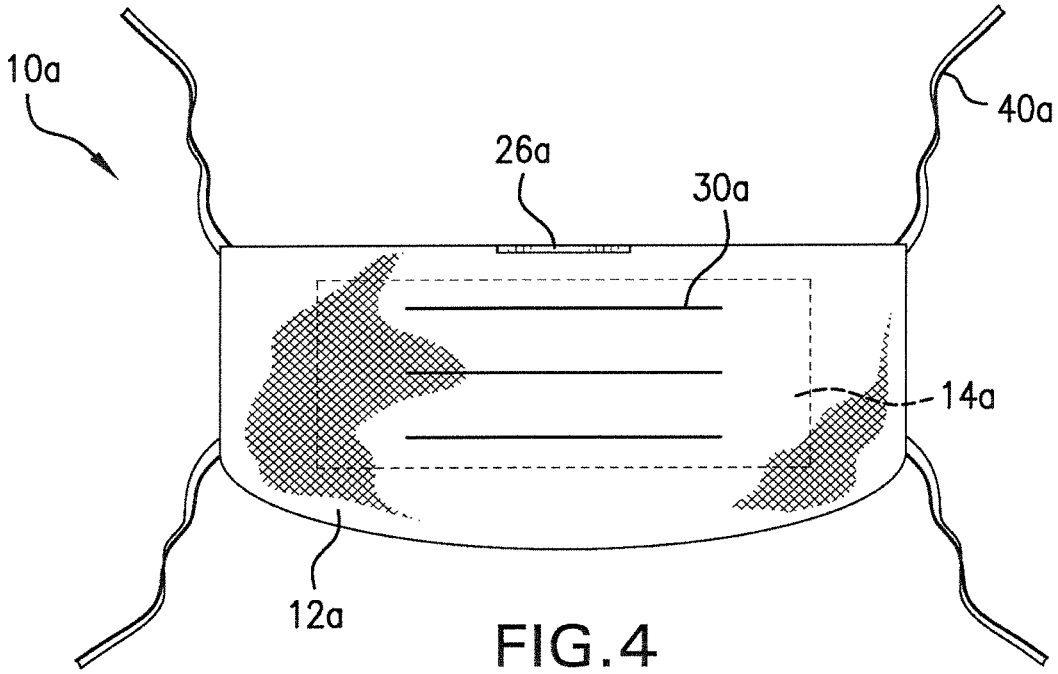
FIG. 4 is front view of the mask of FIG. 3 showing the front or outside of the face mask.

FIGS. 3-4 illustrate a modification that can be made to the face mask 10 in FIGS. 1-2. In the face mask 10*a* of the embodiment of FIGS. 3-4, the rear or inner layer 14*a* can be sized and configured to be smaller than the front or outer layer 12*a*, so that a border 25*a* is provided on the inner surface of the outer layer 12*a* surrounding the inner layer 14*a*. The inner layer 14*a* can have approximately the same size and shape as a conventional filter 24, and a slit 22*a* can be provided along any edge of the inner layer 14*a*.

Other than this modification, the face mask 10*a* is the same as the face mask 10, so the same elements in both embodiments are designated with the same numerals except that an "a" has been added to the embodiment in FIGS. 3-4.

The face mask 10*a* provides the benefit that it can be slightly lighter than the face mask 10 in that there is less material for the inner layer 14*a*. The cotton in the polyester-cotton blend for the outer layer 12*a* will still provide filtering efficacy for the outer layer 12*a* along the border 25*a*, and having only one layer at the border 25*a* will enhance breathability (as there is only one layer and not multiple layers) and further provide an enhanced snug fit as the single layer at the location of the border 25*a* provides better conformity and fit to the wearer's face.

In this embodiment, the inner layer 14*a* functions to define or form the pocket space 20*a*, so it can even be provided as 100% polyester if desired. The fact that there is a filter 24 between the layers 12*a* and 14*a* (or even layers 12 and 14 in FIGS. 1-2) means that the inner layer 14 or 14*a* can be provided as 100% polyester as the filter 24 is providing the filtering function.

Figure 5:
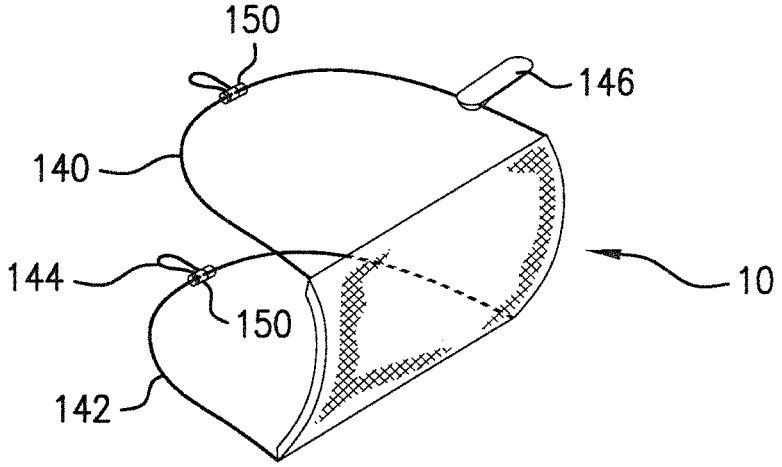
FIG. 5 is a front perspective view of the face mask of FIG. 1 with modifications made thereto.
Figure 6:
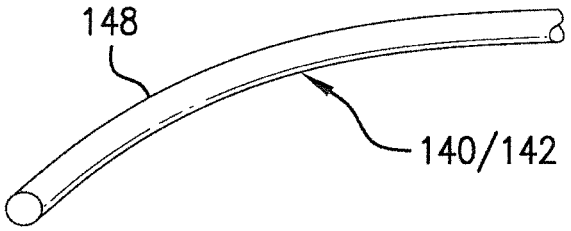
FIG. 6 is a segment view of a cord that can be used as a strap for the face mask of FIG. 5.

FIGS. 5 and 6 illustrate modifications that can be made to the face masks 10 and 10*a* in FIGS. 1-4. Instead of four straps 40, with pairs of straps 40 that are meant to be tied together, two single straps 140 and 142 can be provided. The upper strap 140 can have opposing ends connected to the two top corners of the face mask 10, and be adapted to fit around the back of the wearer's head. The lower strap 142 can have opposing ends connected to the two bottom corners of the face mask 10, and be adapted to fit around the wearer's neck.

Conventional cloth masks provide two similar straps in the form of elastic straps. Since these straps are made of elastic, the fit around a wearer's neck and head can be loose at times, which is not desirable for use during a sporting activity as the face mask can easily slip and/or fall off. For similar reasons, straps that are adapted to be looped around a wearer's ears (e.g., as with most medical masks) are also not desirable for use during a sporting activity as the face mask can also easily fall off. Straps 40 that are meant to be tied together provide for a good and custom fit, but can be inconvenient to use because it takes time and effort to tie two sets of straps together.

To provide a more effective and comfortable fit, the present invention provides a plastic single hole cord lock 150 (see FIG. 7) can be provided on each strap 140 and 142 for allowing the wearer to adjust the tightness and fit of each strap 140, 142. The cord lock 150 operates by allowing two locations of the strap to be extended therethrough, and then clipping or locking the strap at a selected location to allow a looped portion 144 of the strap 140/142 to fixed. The cord lock 150 can be any conventional cord lock, and can include a cord lock with a conventional spring-loaded design. It is possible to provide a single cord lock 150 for the strap 140 only, the strap 142 only, or for both straps 140 and 142. This allows the wearer with different options for adjusting the tightness and fit.

According to the present invention, the straps 140 and 142 can be provided in an elastic or non-elastic material. For example, FIG. 6 illustrates a sectional view of a circular or rounded cord 148 that can be used as the strap 140/142. One example can be the "Elastic Nylon Bungee Stretch Shock Cords" that are provided in 1/32 inch and 1/16 inch diameters, and which are normally sold for use with crafts and are widely available through many vendors. The degree of elasticity of the cord 148 is not important in this embodiment, since the provision of the cord locks 150 provide for the adjustability that would was otherwise provided by the elastic strap. As a result, even a non-elastic cord can be used. This adjustability is especially useful when the wearer is engaging in a sporting activity. For example, if the wearer wants to experience better air flow, he/she can adjust either or both straps 140/142 to be tighter or looser, so as to provide a greater pocket of space between the inside of the face mask 10 and the wearer's face. The cord lock 150 provides a quick and convenient way for the wearer to adjust the straps 140/142, and the provision of a cord lock 150 with either or both of the straps 140 and 142 also contributes to this adjustability.

In addition, a removable securing mechanism, such as a VELCRO™ strap 146, can be fixedly secured to either of the straps 140 or 142, or even to a part of the outer layer 12. This removable securing mechanism can also be a hook, a clip, a latch mechanism, or any other similar mechanism that allows the wearer to tie the face mask 10 to any loop or handle that is usually provided on backpacks, gym bags, and carrying bags. As a result, the face mask 10 does not need to be stuffed inside a bag, but can be removably tied to the outside of a bag to allow the face mask 10 to air, as well as minimizing the chances of losing, dropping or misplacing the face mask 10.

Figure 7:
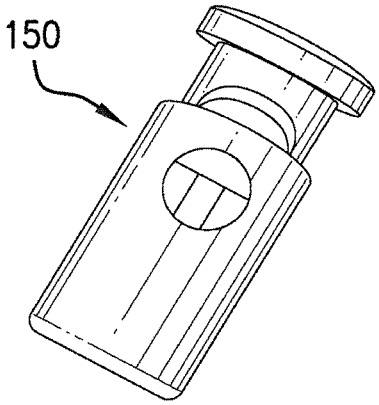
FIG. 7 is a perspective view of a cord lock that can be used with the face mask of FIG. 5.

Thus, the embodiment in FIGS. 5-7 illustrates different ways in which the face mask 10 can be adapted for use in extreme sporting or other activities where the face mask 10 requires more effective securement to prevent it from slipping or falling off, while providing comfort, fit, breathability and protection. A face mask that incorporates all of the features shown and described in connection with FIGS. 1-7 will provide the wearer with a face mask that is versatile for use in almost any environment or any activity, so that the wearer can have one convenient face mask for use instead of needing to store, wash and switch out multiple face masks, often in the same day. Given the number of accessory items that any individual now needs to carry around (e.g., smartphone, purses, etc.), adding a face mask as a necessary accessory will only increase the inconvenience and burden. Therefore, a face mask that is convenient, versatile and effective will help to lessen the burden on all individuals in this new "normal" that the world now lives in.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A method of using a face covering device for an athletic activity with adjustable breathability, comprising:

providing a face covering having:

an outer layer made of a polyester-cotton blend material, wherein the outer layer has a plurality of pleats, a left edge and a right edge, and further including at least one strap having a length, a first end attached to the left edge of the outer layer, a second end attached to the right edge of the outer layer, and an adjustment mechanism provided on the at least one strap;

an inner layer that is stitched or sewn to the outer layer in a manner which defines a pocket space between the inner and outer layers, and having a slit provided along an edge of the inner layer providing access to the pocket space; and a removable securing mechanism fixedly secured to the face covering;

inserting a filter piece through the slit into the pocket space, wherein the filter piece is made of a cotton blended material;

wearing the face covering with the inserted filter piece on a wearer's face for a first activity;

removing the face covering from the wearer's face;

removably securing the removable securing mechanism to a bag;

removing the filter piece from the pocket space through the slit;

removing the securing mechanism from the bag;

wearing the face covering without the filter piece on the wearer's face for a second activity which is an athletic activity;

adjusting the length of the at least one strap by manipulating the adjustment mechanism.

2. The method of claim 1, wherein the inner layer is made of a polyester-cotton blend material.

3. The method of claim 1, wherein the replaceable filter piece is made of a polyester-cotton blend of material.

4. The method of claim 1, wherein the adjustment mechanism is a cord lock.

5. The method of claim 2, wherein the replaceable filter piece is made of a polyester-cotton blend of material.

6. The method of claim 5, wherein the adjustment mechanism is a cord lock.

* * * * *